US008881538B2

(12) United States Patent
Dupont et al.

(10) Patent No.: US 8,881,538 B2
(45) Date of Patent: Nov. 11, 2014

(54) SYSTEM FOR TRANSFER OF A LIQUID SUCH AS LIQUEFIED NATURAL GAS FROM A SHIP SUCH AS A LIQUEFIED NATURAL GAS CARRIER AND A FLOATING OR FIXED UNIT

(75) Inventors: Bernard Dupont, Eaubonne (FR); Stephane Paquet, Sartrouville (FR)

(73) Assignee: Societe Europeenne d'Ingenierie Mecanique—EURODIM, Rueil Malmaison Cedex (FR)

( * ) Notice: Subject to any disclaimer, the term of this patent is extended or adjusted under 35 U.S.C. 154(b) by 1180 days.

(21) Appl. No.: 12/373,069

(22) PCT Filed: Jul. 12, 2007

(86) PCT No.: PCT/FR2007/051656

§ 371 (c)(1), (2), (4) Date: Jan. 28, 2009

(87) PCT Pub. No.: WO2008/007033

PCT Pub. Date: Jan. 17, 2008

(65) Prior Publication Data

US 2009/0205343 A1 Aug. 20, 2009

(30) Foreign Application Priority Data

Jul. 13, 2006 (FR) ..... 06 52985

(51) Int. Cl.

| | |
|---|---|
| ***E03B 1/00*** | (2006.01) |
| ***B63B 27/24*** | (2006.01) |
| ***B67D 9/02*** | (2010.01) |

(52) U.S. Cl.

CPC .. *B63B 27/24* (2013.01); *B67D 9/02* (2013.01)
USPC ..... 62/50.7; 137/615

(58) Field of Classification Search

USPC ..... 137/615; 62/50.1, 50.7
See application file for complete search history.

(56) References Cited

U.S. PATENT DOCUMENTS

| | | | | |
|---|---|---|---|---|
| 4,206,782 | A * | 6/1980 | Tuson | 137/615 |
| 4,220,177 | A * | 9/1980 | Gill | 137/615 |
| 4,299,261 | A * | 11/1981 | Talafuse | 141/387 |
| 4,388,948 | A * | 6/1983 | Carminati et al. | 137/615 |
| 4,393,906 | A * | 7/1983 | Gill | 141/387 |
| 4,408,943 | A * | 10/1983 | McTamaney et al. | 137/899.2 |
| 6,877,527 | B2 | 4/2005 | Dupont et al. | |
| 6,886,611 | B2 | 5/2005 | Dupont et al. | |
| 6,938,643 | B2 * | 9/2005 | Pollack | 137/615 |
| 7,147,021 | B2 | 12/2006 | Dupont et al. | |
| 7,299,835 | B2 | 11/2007 | Dupont et al. | |
| 7,338,091 | B2 | 3/2008 | Ghilardi | |
| 2004/0099336 | A1 * | 5/2004 | Le Devehat | 141/387 |
| 2009/0165874 | A1 * | 7/2009 | Pollack et al. | 137/615 |

* cited by examiner

*Primary Examiner* — Marc Norman
*Assistant Examiner* — Devon Russell
(74) *Attorney, Agent, or Firm* — Leydig, Voit & Mayer, Ltd.

(57) ABSTRACT

A system for transfer of a liquid, such as liquefied natural gas, from a ship such as a liquefied natural gas carrier and a floating or fixed production and/or storage unit. The system has articulated arms and has n degrees of freedom, generally six, provided by rotating joints. At least one of the rotating joints is located on the ship.

7 Claims, 7 Drawing Sheets

SYSTEM FOR TRANSFER OF A LIQUID SUCH AS LIQUEFIED NATURAL GAS FROM A SHIP SUCH AS A LIQUEFIED NATURAL GAS CARRIER AND A FLOATING OR FIXED UNIT

FIELD OF THE INVENTION

The invention concerns a system for transfer of a liquid such as liquefied natural gas between a ship such as an LNG carrier vessel and a floating or fixed liquid production or storage unit, of the type with an articulated arm and with n degrees of freedom, generally 6, each ensured by a rotating joint.

BACKGROUND

A system of this type is known, for example, from the document WO2005/105565. This arm must be capable of being connected to and disconnected from the LNG carrier with complete safety under difficult sea conditions. This system and generally all liquid transfer systems based on inter-articulated rigid pipings have the disadvantage that all the rotating joints are provided on the articulated arm, including three at the end of the arm which consequently has a complex, cumbersome structure with large spatial requirements, and whose rotations are difficult to control particularly while handling the connections/disconnections under conditions of constant movement.

SUMMARY OF THE INVENTION

The objective of the invention is to compensate for this disadvantage.

To realize this objective, the transfer system according to the invention is characterized in that at least one rotating joint is provided on the ship.

According to one characteristic of the invention, the transfer system is characterized in that the articulated arm has a support segment connected to fixed piping of the floating or fixed unit, an exterior arm segment and an interior arm segment that have at least three rotating joints, while one to three other rotating joints are provided on the piping attached to the manifold and whose end carries the flange for connection of the articulated arm.

According to another characteristic of the invention, the transfer system is characterized in that the articulated arm and the fixed piping of the manifold have suitable elbows and U-shaped parts for ensuring the appropriate orientation of the axes of rotation of the rotating joints.

According to yet another characteristic of the invention, the system is characterized in that it has a device for guiding and handling the connection device of the articulated arm, of the type with a cone and trumpet, which is arranged laterally with respect to the connection device.

According to yet another characteristic of the invention, the transfer system is characterized in that it has a device for guiding and handling the connection device of the type with cone and trumpet, which is integrated coaxially with respect to the connection means.

BRIEF DESCRIPTION OF DRAWING FIGURES

The invention will be better understood and other objectives, characteristics, details and advantages thereof will appear more clearly in the course of the following explanatory description with reference to the appended schematic drawings illustrating several embodiments of the invention and in which.

DETAILED DESCRIPTION

Figure 1:
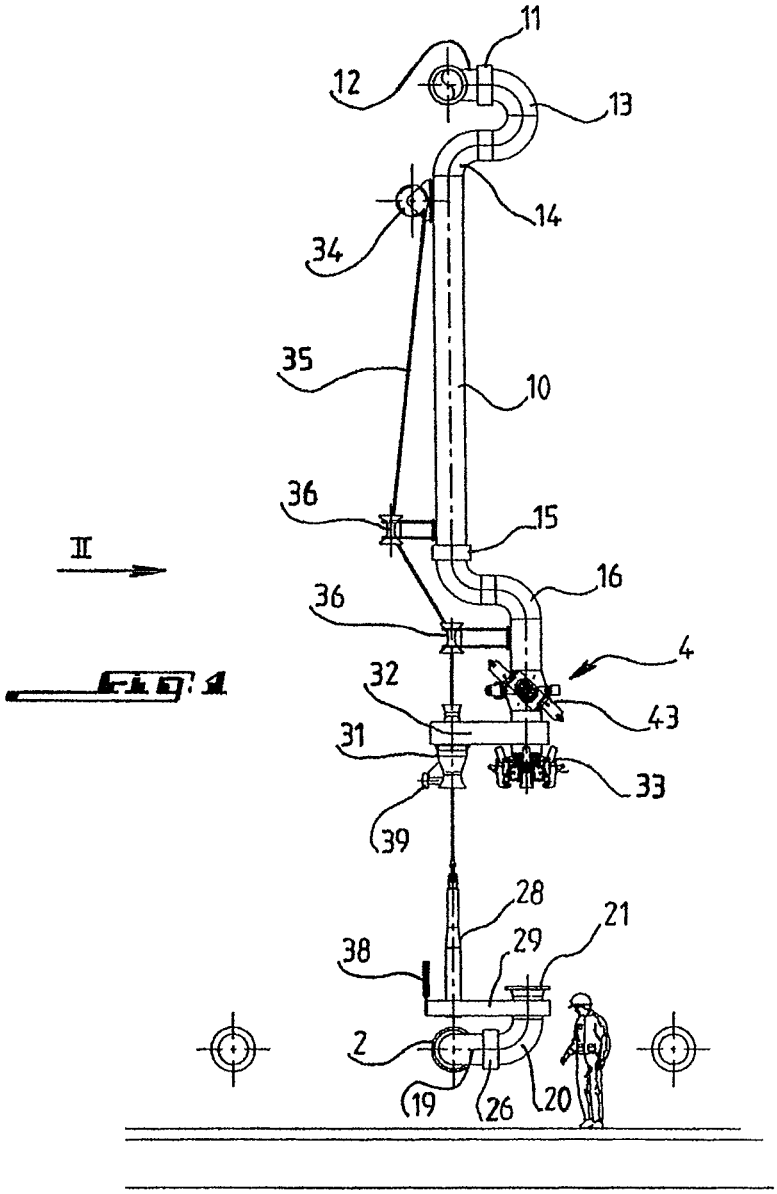
FIG. 1 is an elevation of a transfer system according to the invention.

The invention will be described hereafter in an embodiment according to which two rotating joints of the system are provided on the ship. In a similar manner, according to the invention, it is possible to envisage providing three rotating joints or only one on the ship.

In these figures, reference 1 designates a ship such as an LNG carrier vessel, 2 designates the manifold of the ship, 3 an articulated transfer arm which at its free end has a device for connection to/disconnection from the manifold, designated by reference 4, and whose other end is connected to piping 5 of the production or storage unit. This unit can be floating or fixed. The figure shows the transfer system in the process of being connected to the manifold of the ship.

Articulated arm 3 essentially has three inter-articulated piping segments, namely first support segment 6 whose free end is connected to piping 5, second arm segment 7, called the internal arm, which is connected to segment 6 by first rotating joint 8 and whose other end is connected by second rotating joint 9 to 90° elbow 12, which is connected at its other end to third rotating joint 11, which connects this elbow to third arm segment 10, called the external arm. The free lower end of the external arm is connected by fourth rotating joint 15 to connection device 4.

It should be noted that the axis of rotation of rotating joint 9 is perpendicular to the axis of rotation of joint 8, that the axis of rotating joint 11 is perpendicular to the axis of joint 9, and that the axis of joint 15 is perpendicular to that of joint 11. Schematic FIG. 3 clearly shows these orientations of the four rotating joints of articulated arm 3, as well as the relative arrangement of the different elbows and interconnecting pieces.

The two missing rotating joints of the transfer device with six degrees of freedom, and therefore of the six rotating joints, are provided on the ship. These two rotating joints are part of connection piping 18, which is attached to manifold 2 and is formed by two 90° elbows 19, 20. One, 27, of the two remaining rotating joints designated by reference numerals 26 and 27 has the same axis as manifold 2 with which elbow 19 is connected, and the other, 26, connects elbows 19 and 20. The axes of rotating joints 26 and 27 are oriented perpendicularly to one another.

The transfer system is equipped with a guiding and handling device, a part of which is mounted on the articulated arm, and another part of which is mounted on connection piping 18.

This guiding device comprises, in a known manner, cone 28, which is oriented by the pulling force of cable 35, indicated further below, and is mounted on support 29, supported by piping element 20, in such a way as to be laterally offset with respect to flange 21, and trumpet 31 mounted on connection device 4 while being laterally offset with respect to service coupler 33 of device 4 by support arm 32. Supports 32 and 29 are located such that the distances between the axis of trumpet 31 and the axis of service coupler 33 and distance between the axis of cone 28 and the axis of flange 21 are identical. The cooperation of the trumpet and the cone ensures that flange surface 21 and the surface of service coupler 33 are parallel.

The device moreover comprises winch 34, which, in the example represented, is mounted on the upper part of exterior arm 10 of articulated arm 3, and cable 35, which can be wound on the winch and brought by cable guides 36 through trumpet 31 for attachment, as in the example represented, at the end of cone 28. Of course, the winch could be arranged at any other appropriate location, for example, on the support arm of the trumpet.

In order to ensure correct positioning, the end of support arm 29 of cone 28 is provided with rotational indexing fork 38 intended for cooperating with rotational indexing roller 39 connected to trumpet 31 with an appropriate lateral offset corresponding to the fork 38/cone 28 offset. It is the cooperation of roller 39 and fork 38 that ensures the proper coaxiality of coupler 33 and flange 21 by rotation about the common axis of cone 28/trumpet 31.

It should be further noted that articulated arm 3 is balanced by means of counterweight 41 arranged on extension 42 of internal arm 7. The balancing must be such that the winch line is always taut during the connection/disconnection phases.

It should be noted that, for the sake of optimized handling, in the figures, the different elements of the arm have been arranged so that, regardless of the angle of rotation of rotating joints 8, 9, 11 and 15, the axis of the trumpet always intersects the axes of rotation of rotating joints 9, 11 and 15. Furthermore, in the realization of such a system, the elements of external arm 10 and of transfer device 4 will be arranged in such a way as to bring the center of gravity of these elements to the level of the axis of trumpet 31 and make them as high as possible. Likewise, on the manifold side, the elements of connection piping 18 have been arranged so that the axis of the cone always intersects the axes of rotation of rotating joints 26 and 27. Furthermore, in its realization, it will be possible to balance connection piping 18 by means of counterweights or elastic devices (of the spring type, for example). All of these arrangements make it possible to optimize the alignment of the winch line, of the axes of the cone and of the trumpet regardless of the relative position between the ship and the storage or production unit and regardless of their movements.

Concerning the functioning of the transfer system according to the invention, it is easily understood that the six rotating joints give the system the necessary six degrees of freedom. The correct positioning of arm 3 on connection flange 21 of the manifold is ensured by guiding device (28, 31, 38, 39), which allows the transfer system according to the invention also to be used in the open sea despite the dynamic movements generated by the surroundings (swell, current, wind). By arranging some of the rotating joints on the ship, the articulated arm can be less cumbersome and lighter in weight.

Figure 2:
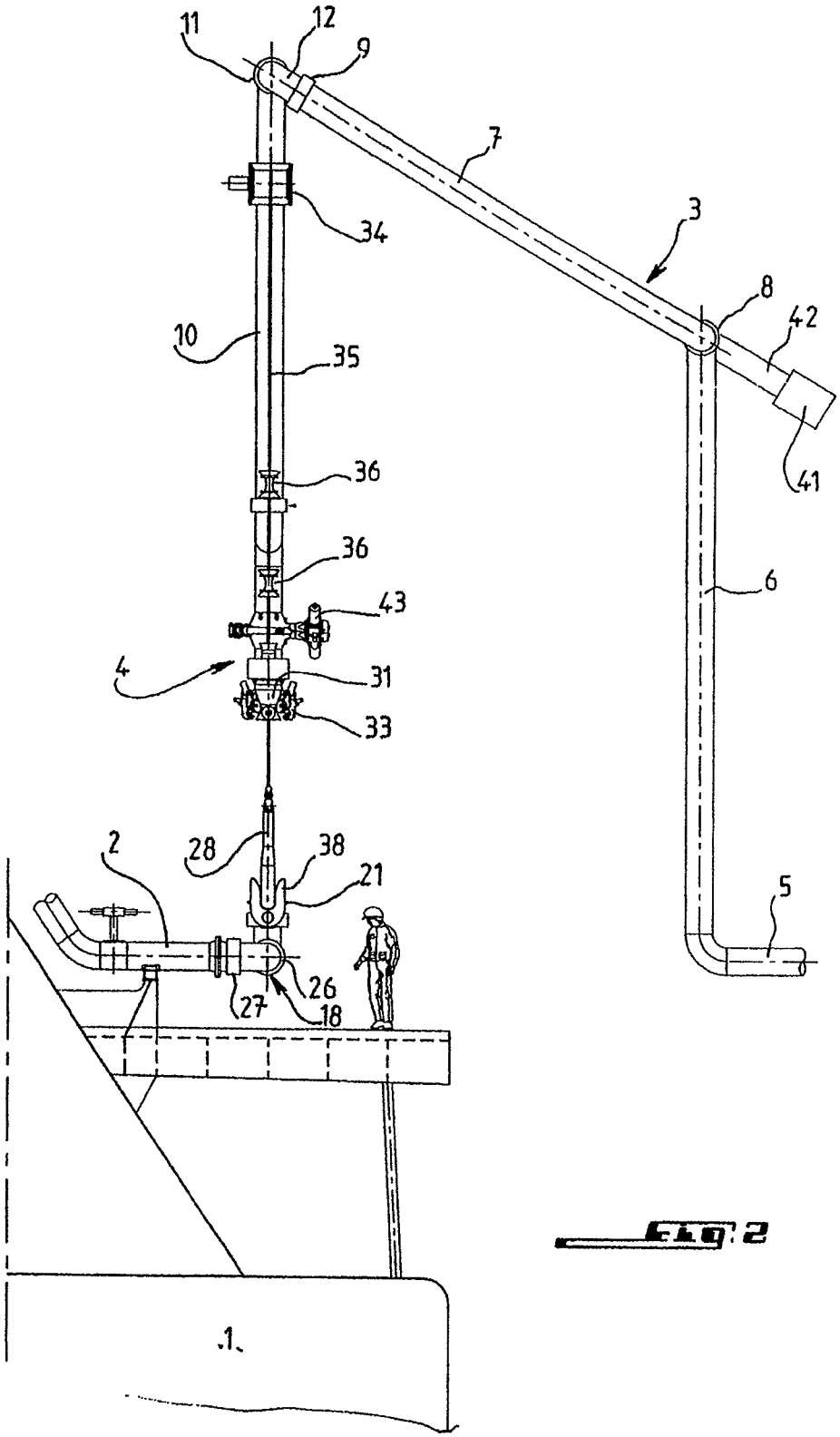
FIG. 2 is a side view of this same transfer system, in the direction of arrow II of FIG. 1.
Figure 3:
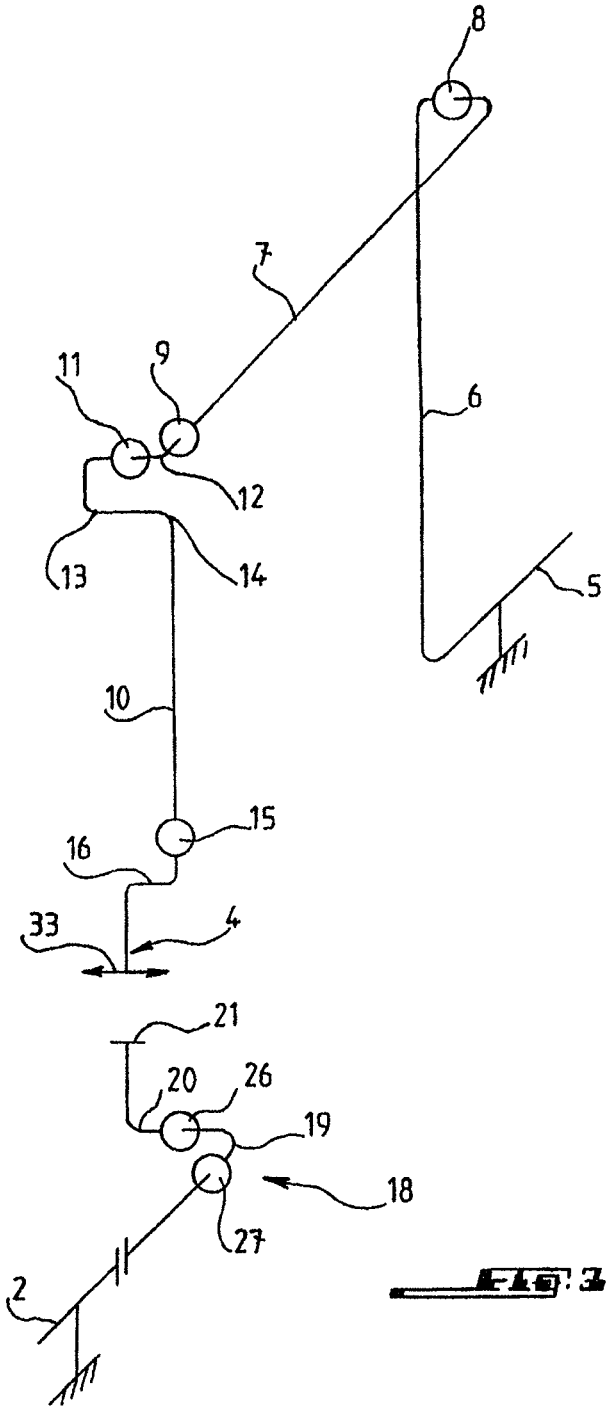
FIG. 3 is a kinematic diagram of the transfer system according to the invention.
Figure 4:
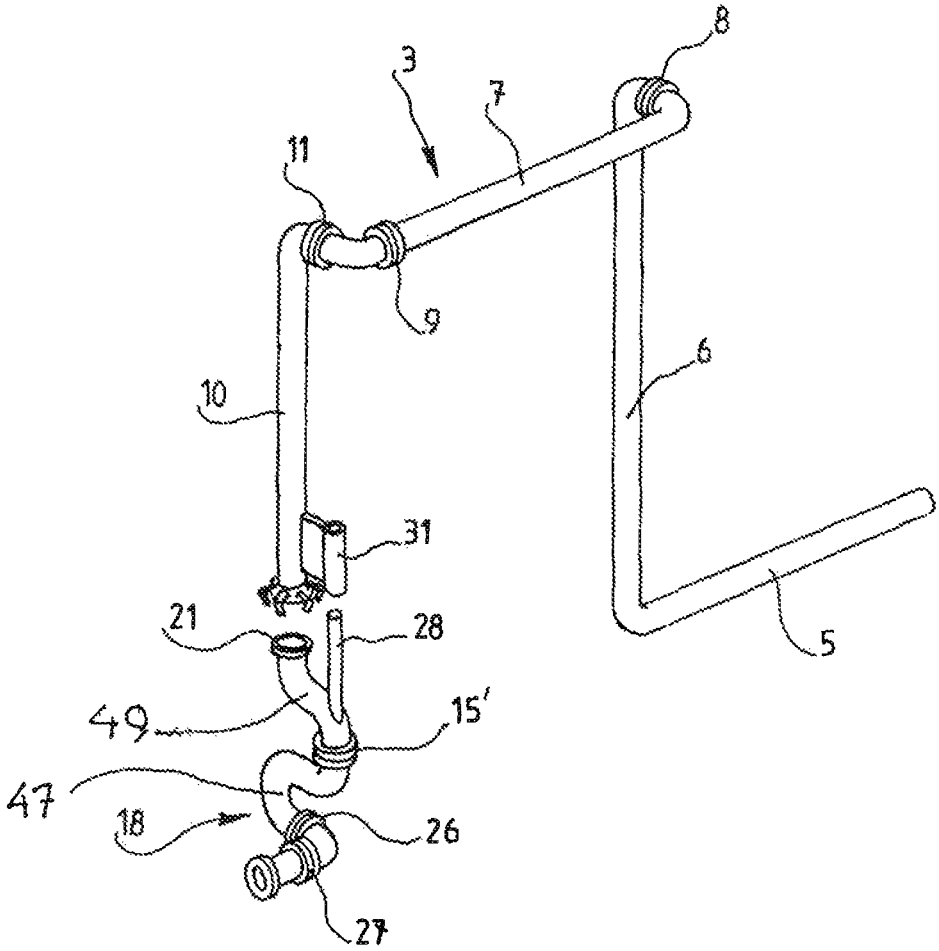
FIG. 4 is a schematic view of another embodiment of the transfer system according to the invention.

FIG. 4 illustrates a realization of the transfer device according to the invention according to which three rotating joints corresponding to rotating joints 8, 9, and 11 of FIGS. 1-3 are on articulated arm 3, whereas piping 18 attached to the manifold has, in addition to rotating joints 26, 27, a third rotating joint designated by reference numeral 15' since it corresponds functionally to rotating joint 15 of FIGS. 1-3. For this purpose, piping 18 has additional U-shaped part 47 and an offset coupler 49, joint 15' being placed between the offset coupler 49 and the U-shaped part 47 in such a way that it always complies with the advantageous geometric arrangements mentioned above. It should be noted that in the case in which this component were to become available, the arrangement with three rotations could be replaced with a single ball-and-socket with a passage for liquid, which would reduce spatial requirements.

Figure 6:
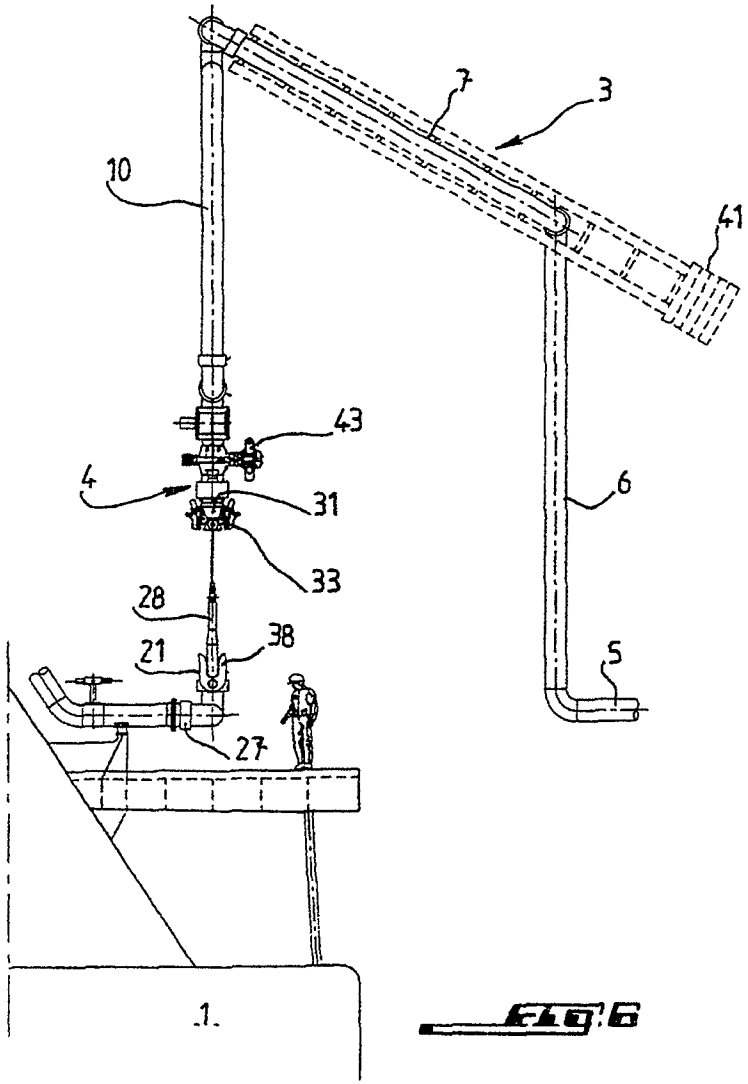
FIGS. 5 and 6 are respectively an elevation and a side view of yet another embodiment of the invention.
Figure 5:
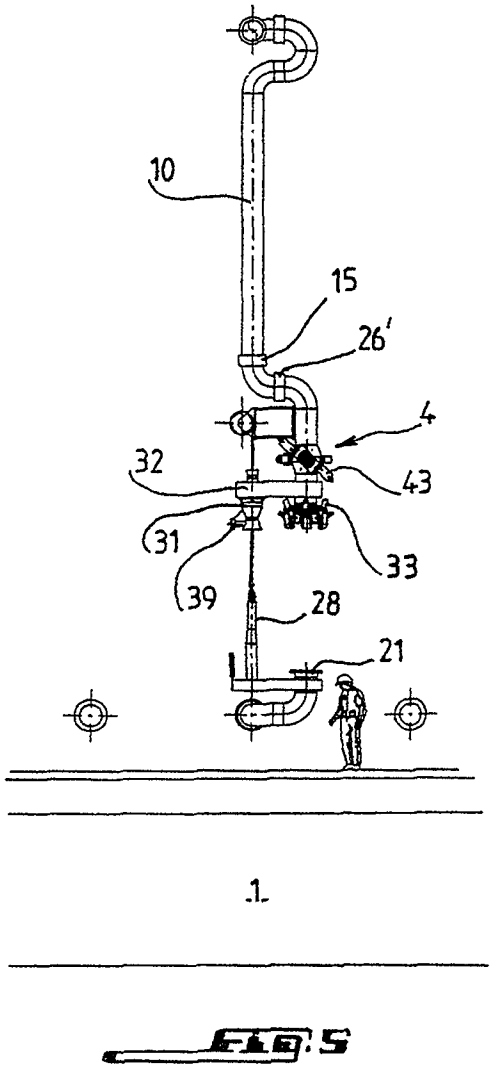

FIGS. 5 and 6 illustrate an embodiment of the invention according to which five rotating joints are provided on articulated arm 3, namely joints 8, 9, 11, 15, and 26', the latter joint corresponding functionally to joint 26 of FIGS. 1-3. Joint 26' is arranged just upstream of connection device 4. Sixth rotating joint 27 remains on piping 18 of the manifold in accordance with FIGS. 1-3.

Figure 7:
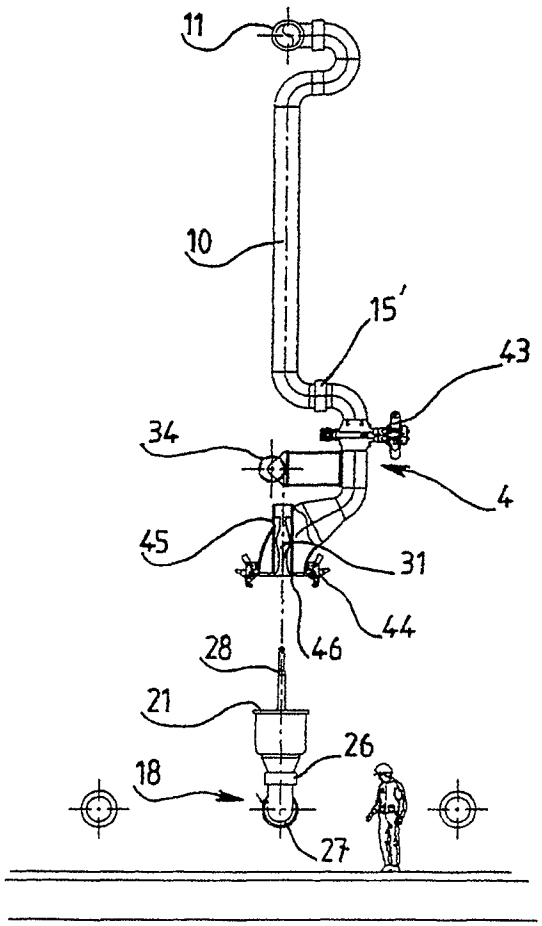
FIG. 7 illustrates yet another embodiment of the transfer system according to the invention.

FIG. 7 shows another embodiment whose particularity lies in the fact that the guiding device and the device for connection of articulated arm 3 are integrated in such a way as to produce a coaxial structure. Cone 28 is arranged coaxially in connection flange 21 of piping 18, which is fixed to the manifold, and trumpet 31 is realized in tubular element 45, which is arranged coaxially with respect to connection opening 46 of the connection device and along its axis, while, as one moves away from the end, the tube assumes the form of a U, which allows tubular element 45 to open towards the outside in the curved part. Winch 34 is housed in the space delimited by the U-shaped tube, above tubular element 45 of trumpet 31, so that the cable can pass through the trumpet. The arrangement of the rotating joints is that of FIGS. 1-3, with four joints on articulated arm 3 and two on the piping of the manifold, with the exception of joint 15 which is no longer in the straight part of exterior arm segment 10 but rather on the upper branch of the U-shaped part of connection device 4. This joint is indicated by reference numeral 15'.

Figure 8:
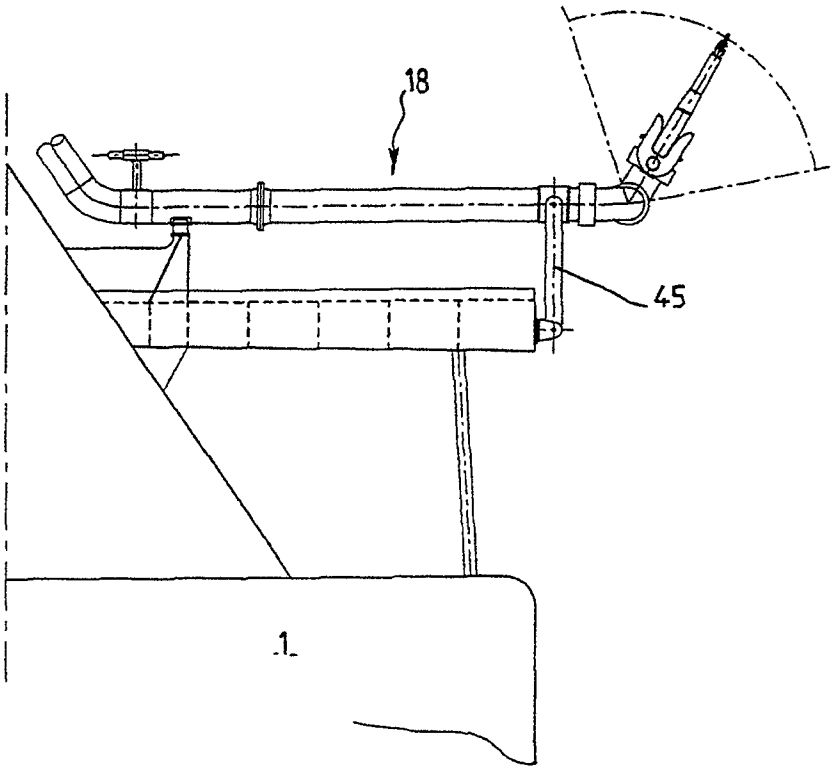
FIG. 8 illustrates the extension of the manifold up to the edge of the ship.

It should also be noted that piping 18 fixed to the manifold could be sufficiently long to offset connection flange 21 toward the location of the edge of the ship and come to rest via support 45 on the structure of the ship to transmit all or part of the forces from the arm to the structure of the ship and relieve the ship's manifold, as shown in FIG. 8.

To complete the description, it should be noted that connection device 4 of articulated arm 3 comprises service coupler 33 and emergency disconnection device 43.

The invention claimed is:

1. A transfer system for transfer of a liquid between a ship and a liquid supply unit, connectable via a first end to the liquid supply unit and via a second end to a manifold on the ship, and having at least six degrees of freedom of movement, the transfer system comprising:

an articulated arm, connected at a first end to the liquid supply unit and carrying, at a second end, a connecting device; and a connection pipe located on the ship, wherein the connection pipe is connected at a first end to the manifold on the ship, the connection pipe is connectable at a second, free end to the connecting device of the articulated arm, the articulated arm includes a succession of arm segments pivotally connected in series and including at least three rotating joints, a stationary vertical support arm segment, an internal arm segment, and an external arm segment, each arm segment of the succession of arm segments, the stationary vertical support arm segment, the internal arm segment, and the external arm segment has a respective first end, a respective second end, and a respective longitudinal axis, the support arm segment is connected by the first end of the support arm segment to the liquid supply unit, and by the second end of the support arm segment, via a first rotating joint having a horizontal rotational axis, to the first end of the internal arm segment, the internal arm segment is pivotally connected to the first end of the external arm segment via a first elbow, and the first elbow has a first elbow portion with an axis extending along the longitudinal axis of the internal arm segment and connected to the second end of the internal arm segment via a second rotating joint having a rotational axis extending along the longitudinal axis of the internal arm segment, and a second elbow portion with an axis perpendicular to the axis of the first elbow portion and connected via a third rotating joint with a rotational axis extending along the axis of the second elbow portion to the first end of the external arm segment, which is perpendicular to the longitudinal axis of the external arm segment, the external arm segment carries, at the second end of the external arm segment, the connecting device, and the connection pipe located on the ship comprises remaining rotating joints providing, with the articulated arm, the six degrees of freedom of movement of the transfer system, each remaining rotating joint having a rotational axis and an elbow portion so that the rotational axes of the remaining rotating joints extend perpendicular to one another.

2. A transfer system for transfer of a liquid between a ship and a liquid supply unit, connectable via a first end to the liquid supply unit and via a second end to a manifold on the ship, and having at least six degrees of freedom of movement, the transfer system comprising:

an articulated arm, connected at a first end to the liquid supply unit and carrying, at a second end, a connecting device; and a connection pipe located on the ship, wherein the connection pipe is connected at a first end to the manifold on the ship, the connection pipe is connectable at a second, free end to the connecting device of the articulated arm, the articulated arm includes a succession of arm segments pivotally connected in series and including at least three rotating joints, a stationary vertical support arm segment, an internal arm segment, and an external arm segment, each arm segment of the succession of arm segments, the stationary vertical support arm segment, the internal arm segment, and the external arm segment has a respective first end, a respective second end, and a respective longitudinal axis, the support arm segment is connected by the first end of the support arm segment to the liquid supply unit, and by the second end of the support arm segment, via a first rotating joint having a horizontal rotational axis, to the first end of the internal arm segment, the internal arm segment is pivotally connected to the first end of the external arm segment via a first elbow, and the first elbow has a first elbow portion with an axis extending along the longitudinal axis of the internal arm segment and connected to the second end of the internal arm segment via a second rotating joint having a rotational axis extending along the longitudinal axis of the internal arm segment, and a second elbow portion with an axis perpendicular to the axis of the first elbow portion and connected via a third rotating joint with a rotational axis extending along the axis of the second elbow portion to the first end of the external arm segment, which is perpendicular to the longitudinal axis of the external arm segment, the external arm segment carries, at the second end of the external arm segment, the connecting device, the connection pipe located on the ship comprises remaining rotating joints providing, with the articulated arm, the at least six degrees of freedom of movement of the transfer system, each remaining rotating joint having a rotational axis and an elbow portion so that the rotational axes of the remaining rotating joints extend perpendicular to one another, and the connecting device comprises a coupler for coupling to the connection pipe on the ship and having an opening with an axis that extends along the longitudinal axis of the external arm segment.

3. The transfer system according to claim 2, wherein the external arm segment comprises a fourth rotating joint having a rotational axis extending along the longitudinal axis of the external arm segment, and the connection pipe includes two of the remaining rotating joints, each of the two remaining rotating having a rotational axis and an elbow so that the rotational axes of the two remaining rotating joints extend perpendicular to one another.

4. The transfer system according to claim 2, wherein the connecting device has, at the free end of the connecting device, a coupler, the connection pipe has a connecting flange for connection to the coupler, the transfer system includes a guiding device for guiding the coupler of the connecting device to a position where the coupler is connected to the connecting flange of the connection pipe, and the guiding device includes a cone and a trumpet, which are laterally located with respect to the coupler and the connecting flange.

5. The transfer system according to claim 4, wherein the trumpet is mounted on the connecting flange in a position laterally offset from the flange, and the cone is mounted on the coupler in a position laterally offset from the coupler.

6. The transfer system according to claim 4, wherein the cone and the trumpet include rotational indexing means for ensuring that the coupler and the connecting flange remain coaxial by rotation about a common axis of the cone and the trumpet.

7. The transfer system according to claim 5, wherein the guiding device comprises a winch mounted on the external arm segment, and a cable wound on the winch and for extending through the trumpet to be attached to the cone when establishing a connection of the articulated arm to the connection pipe.

* * * * *